US007026891B2

(12) United States Patent
Mazzochette

(10) Patent No.: US 7,026,891 B2
(45) Date of Patent: Apr. 11, 2006

(54) MONOLITHIC DISC DELAY LINE

(75) Inventor: Joseph Mazzochette, Cherry Hill, NJ (US)

(73) Assignee: Lamina Ceramics, Inc., Westampton, NJ (US)

( * ) Notice: Subject to any disclaimer, the term of this patent is extended or adjusted under 35 U.S.C. 154(b) by 346 days.

(21) Appl. No.: 10/041,267

(22) Filed: Jan. 8, 2002

(65) Prior Publication Data

US 2003/0128082 A1 Jul. 10, 2003

(51) Int. Cl.
*H01P 1/18* (2006.01)

(52) U.S. Cl. ..... 333/161; 333/156

(58) Field of Classification Search ..... 333/156, 333/161, 140

See application file for complete search history.

(56) References Cited

U.S. PATENT DOCUMENTS 2,440,652 A * 4/1948 Beverly ..... 333/156
3,643,182 A * 2/1972 Swanson ..... 333/140
3,769,614 A * 10/1973 Bernstein ..... 333/156
3,781,955 A 1/1974 Lavrinenko et al.
4,627,160 A 12/1986 Herron et al.
4,675,627 A * 6/1987 Johnston ..... 333/161
4,783,359 A 11/1988 Fleischer et al. ..... 428/209
5,923,230 A 7/1999 Yoshida et al. ..... 333/161

FOREIGN PATENT DOCUMENTS

GB 924131 4/1963
JP 401096911 A 4/1989

* cited by examiner

*Primary Examiner*—Benny Lee
(74) *Attorney, Agent, or Firm*—Lowenstein Sandler PC

(57) ABSTRACT

In accordance with the invention, a delay line comprises a spirally coiled strip transmission line encapsulated within conductive ground discs. In an advantageous embodiment the delay line is a monolithic ceramic structure produced by forming the stripline on green ceramic tape, spirally rolling the green stripline, encasing the rolled stripline in green ceramic encapsulating discs and cofiring the green assembly into a monolithic compact disc.

8 Claims, 5 Drawing Sheets

MONOLITHIC DISC DELAY LINE

FIELD OF THE INVENTION

This invention relates to transmission delay lines for guided electromagnetic waves (RF and microwave). In particular, it relates to delay lines in the form of a monolithic, compact discs and to methods for making such delay lines.

BACKGROUND OF THE INVENTION

Delay lines are important components in many microwave and radio frequency (RF) circuits. They provide fixed delays and phase shifts that can perform a variety of signal processing functions. For example, delay lines are used in feed forward amplifiers to provide phase shifts effective to cancel large distortion products.

Typical transmission delay lines comprise lengths of coaxial cable or stripline transmission lines ("striplines"). For compactness, coaxial cable delay lines are helically coiled and striplines are formed in a meandering configuration. Coiled coaxial delay lines are reliable and low loss. However they are large, expensive and difficult to attach to conventional electronic circuit boards. Meandered striplines are inexpensive and easy to construct and connect, but they have relatively high loss, and the many bends associated with their meandering paths create unwanted reflections and delay distortion. Accordingly there is a need for an improved compact delay lines.

SUMMARY OF THE INVENTION

In accordance with the invention, a delay line comprises a spirally coiled strip transmission line encapsulated within conductive ground discs. In an advantageous embodiment the delay line is a monolithic ceramic structure produced by forming the stripline on green ceramic tape, spirally rolling the green stripline, encasing the rolled stripline in green ceramic encapsulating discs and cofiring the green assembly into a monolithic compact disc.

BRIEF DESCRIPTION OF THE DRAWINGS

The advantages, nature and various additional features of the invention will appear more fully upon consideration of the illustrative embodiments now to be described in detail in connection with the accompanying drawings. In the drawings.

It is to be understood that these drawings are for purposes of illustrating the concepts of the invention and are not to scale.

DETAILED DESCRIPTION OF THE INVENTION

Figure 1:
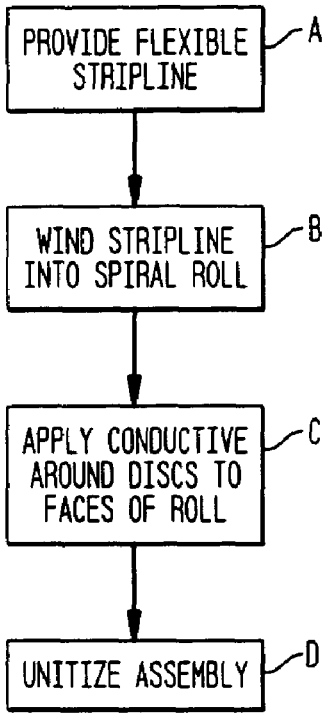
FIG. 1 is a flow diagram of the steps of a preferred process for making a delay line.

Referring to the drawings, FIG. 1 is a block diagram of the steps in an advantageous process for making a delay line. The first step, shown in block A, is to provide a flexible stripline, preferably in the form of a green ceramic tape structure.

Figure 2:
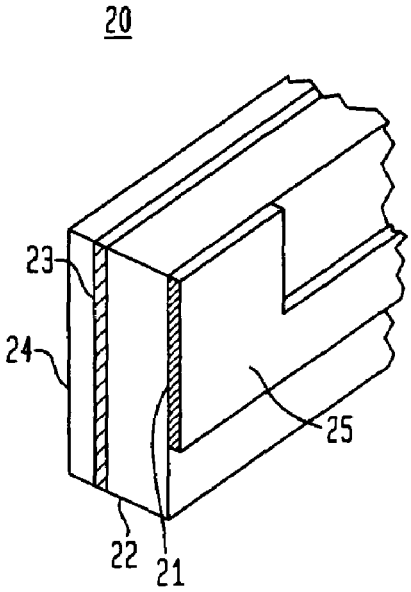
FIG. 2 shows a green stripline tape used in the process of FIG. 1.

FIG. 2 illustrates an advantageous green ceramic stripline 20 in partial cross section. The green stripline 20 comprises a green center conductive strip 21, a green ceramic insulating layer 22, a green ground conductive layer 23 and a second green ceramic insulating layer 24. This green ceramic stripline can be conveniently fabricated by printing green center conductive layer 21 as conductive ink on a first green ceramic tape corresponding to layer 22 and printing green ground conductive layer 23 on a second green ceramic tape corresponding to layer 24. The two tapes can be stacked and pressed to form the green stripline 20 of FIG. 2. The end portions of the green stripline 20 can be adapted to facilitate electrical contacts by providing the center strip 21 with an extension 25 to the tape edge.

The second step shown in block B of FIG. 1 is to spirally wind the flexible stripline. Advantageously the stripline is wound around a central cylinder which conveniently can provide electrical contact with the center conductive strip 21.

Figure 3:
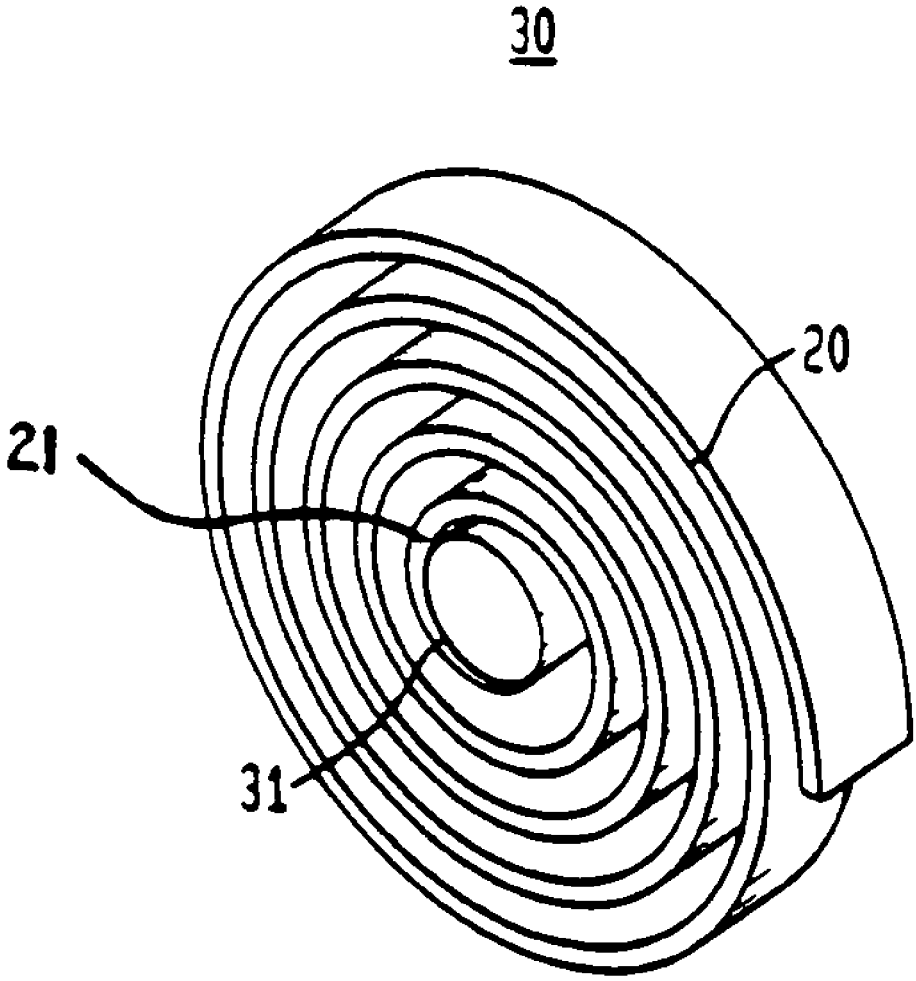
FIG. 3 illustrates the green tape wound into a spiral roll.

FIG. 3 is an end view of the spirally wound roll 30 formed by winding the green ceramic stripline 20 around a central cylinder 31. Cylinder 31 can be an extruded green ceramic rod coated with an appropriate pattern of conductive ink to achieve electrical contact with center strip 21. The best electrical and mechanical performance is achieved if the tapes are rolled such that each center strip 21 is directly aligned over itself on subsequent layers of the roll. The inside diameter of the roll (around cylinder 31) should be large enough to avoid cracking stripline 20. Advantageously, the stripline 20 is wound or pressed with sufficient tightness that an isostatic lamination occurs, creating a single body with each layer of the roll adhering to the adjacent layer.

The third step, Block C of FIG. 1, is to apply conductive ground discs to the faces of the roll. The discs include conductive material to contact the ground layer 23, preferably along its entire rolled length and on both the top and bottom faces.

Figure 4:
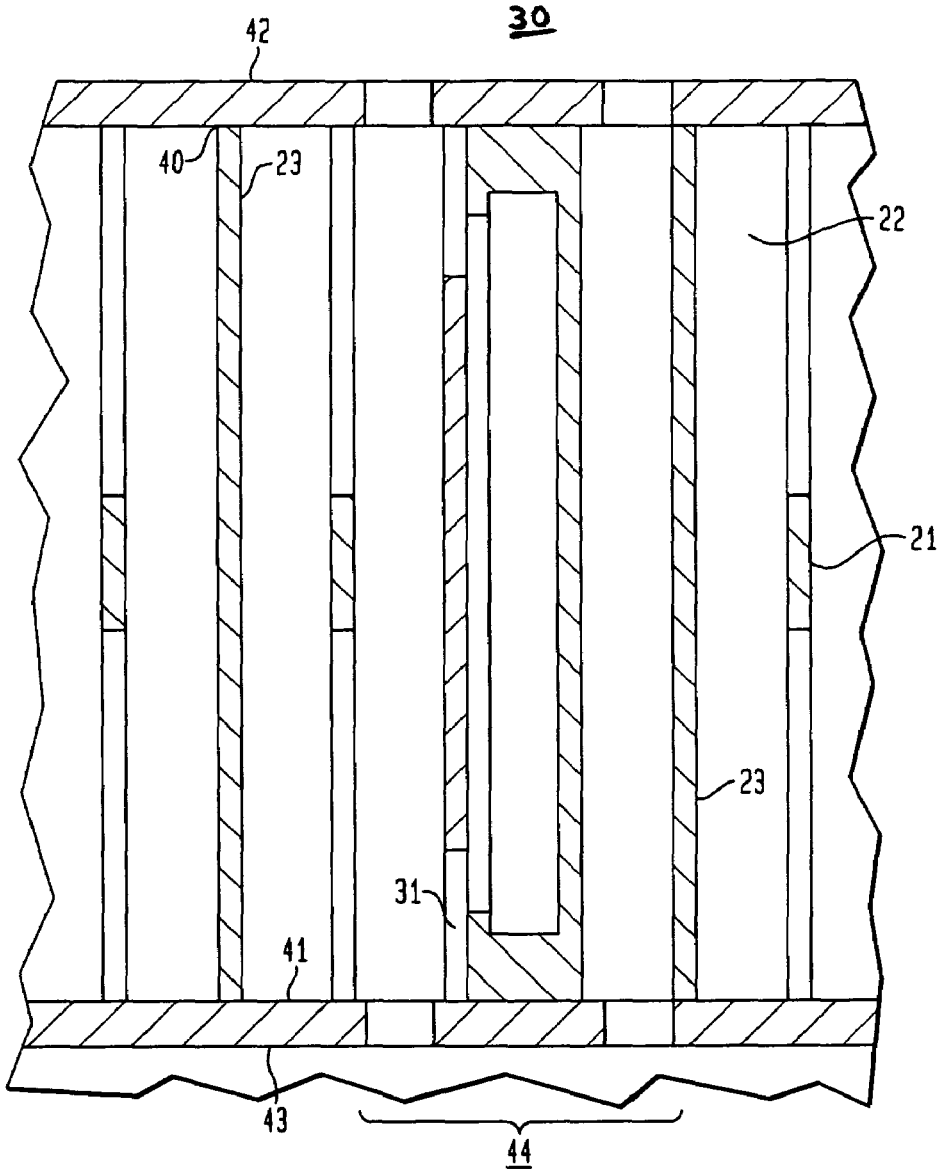
FIG. 4 is a schematic cross section of the encapsulated coil showing advantageous internal connection features.

FIG. 4 is a partial cross section of a roll 30 having an upper face 40 and a lower face 41. Encapsulating discs 42 and 43 in the form of green ceramic discs, each having a conductive ink surface, are disposed on the faces 40, 41 respectively, to encapsulate the faces and electrically contact the ground layers 23. The discs may include one or more insulated via holes 44 to facilitate electrical contact with the center cylinder 31. The discs 42, 43 are advantageously pressed onto the faces to laminate the disc onto the structure.

After the discs are laminated, the assembly can be unitized (FIG. 1, Block D). For example, the assembly can be fired in a kiln to form an integral body. Firing melts the glass in the green ceramic and conductive inks. The glass cools when the assembly is removed from the firing kiln, fusing the entire structure together.

In a first variation of this process a plurality of spirally wound striplines 30 can be cut from a single roll. To accomplish this, the process of FIG. 1 is applied to layer ceramic tapes 22, 24 to form a roll having an axial length equal to the axial length of several stripliners. Tape 22 is provided with a plurality of axially spaced apart central conductors, and after the sheet is rolled and the roll is laminated, the roll can be sliced transverse to the axis between successive central conductors to produce several compact striplines from the single roll. To facilitate accurate slicing, a line of via holes can be formed in sheet 22 midway between central conductors. Encapsulating discs are then formed over the faces of each rolled stripline as described above.

Figure 5:
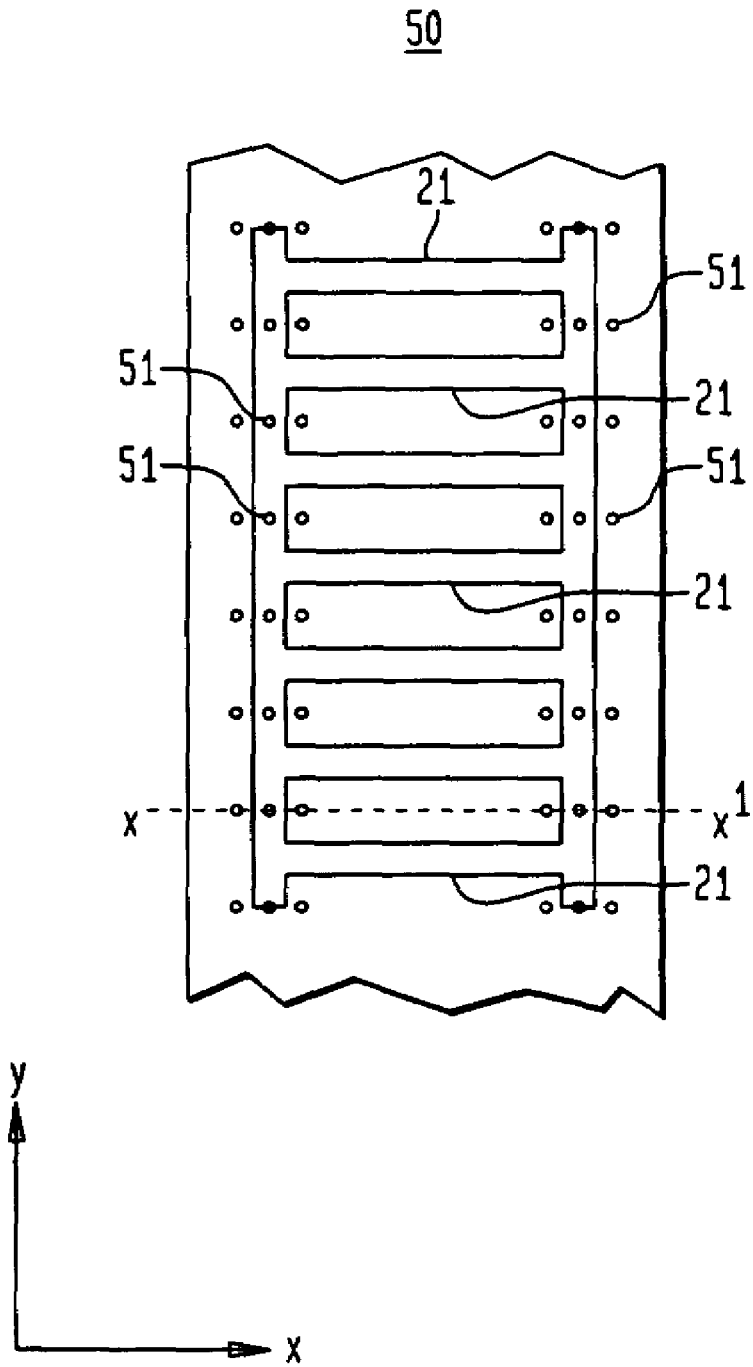
FIG. 5 is a schematic longitudinal cross section of a multistripline roll.

FIG. 5 illustrates a schematic cross longitudinal section of a multiple stripline roll 50 before slicing. The roll includes a plurality of center conductors layers 21 periodically spaced apart along the axial dimension. A plurality of via holes 51 advantageously formed midway between successive center conductors provide precise guidance for each line of slicing xx'. (For convenience only one line of slicing is shown).

Figure 6:
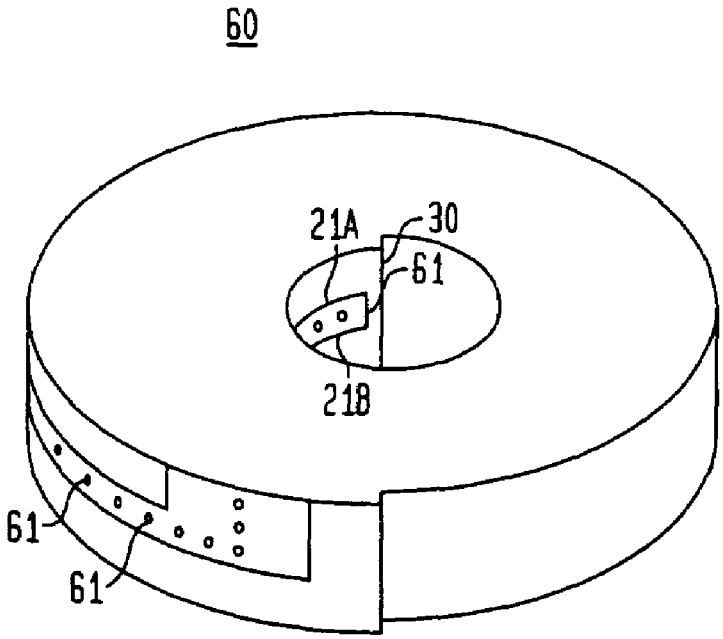
FIG. 6 is a schematic respective view of delay line having a doubled stripline.

In a second variation of the process of FIG. 1, the delay of each stripline disc is doubled by folding the center conductor back on itself on the same ceramic strip. As shown in FIG. 6, in essence, the center conductor 21 does a "u-turn" on the insulating strip, providing twice the length and twice the delay. A series of ground vias helps separate the two lines. Preferably the turn is at the center of the wound spiral and both the input and the output are taken from the periphery of the spiral roll.

FIG. 6 is a schematic perspective view of a delay line 60 having a doubled stripline. The two halves of the line 21A and 21B are connected by conductive segment 61 at the center of the roll 30. Thereafter, the two halves are electromagnetically separated by space and by a series of ground vias 61. The ground vias are spaced apart along the length of the stripline by a spacing of less than one-tenth of a wavelength at the highest frequency of operation.

Figure 7:
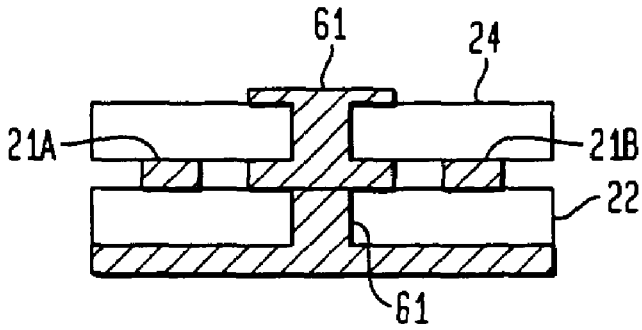
FIG. 7 is a cross section of the stripline used in FIG. 6.

As better shown in the stripline cross section of FIG. 7, the ground vias 61 are conductive vias located between the "center" conductor halves 21A, 21B. The conductive ground vias extend through insulating layers 22, 24 to electrically contact the ground layers on both sides of the striplines. These closely spaced ground connections effectively preclude the electromagnetic signals on 21A from interacting with 21B and vice versa.

The invention can now be understood more clearly by consideration of the following specific embodiment.

EXAMPLE

A disc delay line can be produced inexpensively and with good electrical properties by the process of FIG. 1 using HTCC or LTCC tape, such as DuPont 951 described in the DuPont material data sheet entitled "951 Low-Temperature Cofire Dielectric Tape". DuPont 6141 silver conductor may be deposited on the surface of flexible, unfired ceramic tape (green tape) to form the ground and strip conductors. Printing can be accomplished using a squeegee printer and a metal stencil for vias and a metal screen for surface conductors. The ground and center strip layers can be deposited on individual green tapes. The metal conductors for the ground and center strip are normally deposited by screen printing thick film inks. After printing the solvents in the material are dried at 70° C. for 30 minutes. The two tapes are then stacked such that the center strip vias are aligned to openings in the ground layer, and then the tapes are tacked together using a high temperature (200° C.), 3 mm diameter tool. The openings prevent unwanted connections between the center strip and the ground planes. Once the tapes are aligned they may be laminated by applying pressure of 3000–4000 PSI at 70° C. The pressure creates adhesion between the binders in the two tapes. After lamination the tapes are rolled. The axis of the roll is perpendicular to the direction of the length of the center strip lines. The best electrical and mechanical performance is achieved if the tapes are rolled such that each center strip is directly aligned over itself on subsequent layers of the roll. The inside diameter of the roll should be large enough to avoid tape cracking. The inside diameter may be formed by rolling on an extruded unfired ceramic rod.

Once the tapes are rolled a second, isostatic lamination is effected by applying pressure of 3000–4000 PSI at 70° C. This lamination creates one mass with each of the layers in the roll adhering to the adjacent layer. Once the roll is laminated it is necessary to slice out the individual delay lines as shown in FIG. 6. Slicing may be completed using a hot wire or knife with a tip temperature of 100° C. The encapsulating disc may now be added to both faces of the roll. The metal conductors for the ground and I/O connections of the encapsulating disc are normally deposited by screen printing. The encapsulating disc may also be green tape with vias, or the disc may be a solid metal layer. An additional lamination step adheres the encapsulating disc to the roll. Once the final lamination is complete the assembly is fired. During the firing process the assembly is heated to ~400° C. to bum off the organic materials in the tape layers. After the bum-off stage, the assembly is heated to 850° C. to sinter the glass. After the assembly exits the furnace and cools, the assembly forms a solid ceramic mass. The glass fuses all the materials in the assembly together forming a solid circuit device that will function as a delay line.

It is understood that the above-described embodiments are illustrative of only a few of the many possible specific embodiments, which can represent applications of the invention. Numerous and varied other arrangements can be made by those skilled in the art without departing from the spirit and scope of the invention.

What is claimed is:

1. A transmission delay line assembly for guided electromagnetic waves, comprising:

a wound spiral rolled strip of insulating ceramic separating a conducting strip and a ground layer of an electromagnetic stripline, the rolled strip having an axis and a pair of faces substantially transverse to the axis;

one or more layers substantially covering the pair of faces, the one or more layers comprising conductive regions contacting the ground layer; and a conductive region providing electrical contact with the conducting strip, wherein the assembly is fired to form an integral body.

2. The delay line assembly of claim 1 wherein the one or more layers substantially covering the pair of faces comprise ceramic layers having conductive regions on the surfaces adjacent the pair of faces for contacting the ground layer.

3. The delay line assembly of claim 1 wherein the conducting strip is doubled along the length of the strip of insulating ceramic by folding the conducting strip back onto itself to form a first half and a second half of the doubled conducting strip.

4. The delay line assembly of claim 3 wherein a plurality of conductive vias connected to the ground layer are disposed along the length of the strip axially intermediate the first half and the second half of the doubled conducting strip.

5. The delay line assembly of claim 1 wherein the delay line further comprises a central cylinder about which the rolled strip is coiled.

6. The delay line assembly of claim 5 wherein the conductive region providing electrical contact with the conducting strip comprises a conductive region on the central cylinder.

7. A transmission delay line comprising:

a coiled stripline comprised of an insulating ceramic separating a conductive strip and a conductive ground layer, wherein the coiled stripline includes a pair of faces; and an encapsulating ceramic with conductive regions disposed thereon, wherein the encapsulating ceramic is disposed on each face of the coiled stripline such that the conductive regions are in electrical contact with the ground layer.

8. The transmission delay line of claim 7, further including second conductive regions in electrical contact with the conductive strip.

* * * * *